US008550172B2

(12) United States Patent
Frisby

(10) Patent No.: US 8,550,172 B2
(45) Date of Patent: Oct. 8, 2013

(54) PLURAL BARRIER VALVE SYSTEM WITH WET CONNECT

(75) Inventor: Raymond A. Frisby, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 316 days.

(21) Appl. No.: 12/970,559

(22) Filed: Dec. 16, 2010

(65) Prior Publication Data

US 2012/0152569 A1 Jun. 21, 2012

(51) Int. Cl.
*E21B 17/02* (2006.01)
*E21B 34/10* (2006.01)

(52) U.S. Cl.
USPC ..... 166/375; 166/242.6; 166/319

(58) Field of Classification Search
USPC ..... 166/319, 332.3, 374, 242.6, 375
See application file for complete search history.

(56) References Cited

U.S. PATENT DOCUMENTS 5,465,787 A * 11/1995 Roth ..... 166/66.4
5,831,156 A * 11/1998 Mullins ..... 73/152.18
5,875,852 A * 3/1999 Floyd et al. ..... 166/387
6,302,216 B1 * 10/2001 Patel ..... 166/375
7,228,914 B2 6/2007 Chavers et al.
7,487,830 B2 2/2009 Wolters et al.
7,640,977 B2 * 1/2010 Jonas ..... 166/242.6
8,056,628 B2 * 11/2011 Whitsitt et al. ..... 166/278
8,286,713 B2 * 10/2012 Broussard ..... 166/341
2003/0211768 A1 * 11/2003 Cameron et al. ..... 439/191
2004/0159444 A1 8/2004 Wolters et al.
2007/0295504 A1 12/2007 Patel et al.
2008/0223585 A1 9/2008 Patel et al.
2010/0206579 A1 8/2010 Guven et al.
2010/0300702 A1 12/2010 Andrews et al.

OTHER PUBLICATIONS

Notification of Transmittal of the International Search Report and the Written Opinion of the International Searching Authority; PCT/US2011/063519; Mailed Jul. 30, 2012; Korean Intellecutal Property Office; 8 pages.
K. Munday et al., "Want to Make Tree Operations Safer? Why Not Use the DHSV as a Barrier?"; Society of Petroleum Engineers, SPE Paper No. 96337; Sep. 24, 2006.
T.A. Nassereddin et al., Electromagnetic Surface-Controlled Sub-Surface Safety Valve: An Immediate Soluation to Secure Wells with Damaged Control Line; Society of Petroleum Engineers, SPE Paper No. 138356; Nov. 1, 2010.
Notification of Transmittal of the International Search Report and the Written Opinion of the International Searching Authority; PCT/US2011/060168; Mailed Jun. 29, 2012; Korean Intellectual Property Office; 10 pages.

* cited by examiner

*Primary Examiner* — Kenneth L Thompson
(74) *Attorney, Agent, or Firm* — Cantor Colburn LLP

(57) ABSTRACT

A barrier valve system includes one or more barrier valves, a connection sub having a first portion and a second portion connecting one or more control lines to each other, and a replacement portion of the connection sub connectable to the first portion subsequent to retrieval of the second portion. The replacement portion has a port from an outside diameter of the replacement portion to an inside diameter of the replacement portion and seals disposed to define an annular space between the replacement portion and the first portion encompassing only valve opening ports in the first portion.

9 Claims, 2 Drawing Sheets

PLURAL BARRIER VALVE SYSTEM WITH WET CONNECT

BACKGROUND

In downhole completion systems using Electric Submersible Pumps (ESPs), there is sometimes the need to retrieve the ESP to surface for repair or replacement. The ESP will be a part of an upper completion that will be retrieved as a unit when retrieval of the ESP is required. This will leave a lower completion in the borehole and hence require that a barrier be actuable to seal off the lower completion. Commonly, a valve is positioned near an uphole extent of the lower completion for this purpose. The valve is actuated usually hydraulically. When replacing the most recently installed completion it is necessary to use a wet connect arrangement to reconnect to the hydraulic control lines of the original barrier valve. While wet connect arrangements are well known and often used in the downhole environment, they are also potentially finicky and hence may not always be favored by operators. The art would therefore well receive alternate systems that increase the ease with which post retrieval valve actuation is achieved.

BRIEF DESCRIPTION

Disclosed herein is a barrier valve system which includes one or more barrier valves, a connection sub having a first portion and a second portion connecting one or more control lines to each other, and a replacement portion of the connection sub connectable to the first portion subsequent to retrieval of the second portion. The replacement portion has a port from an outside diameter of the replacement portion to an inside diameter of the replacement portion and seals disposed to define an annular space between the replacement portion and the first portion encompassing only valve opening ports in the first portion.

Also disclosed herein is a barrier valve system which includes one or more barrier valves and a connection sub having a first portion and a second portion connecting one or more control lines to each other. A replacement portion of the connection sub is connectable to the first portion subsequent to retrieval of the second portion, and the replacement portion is configured to convey applied tubing pressure to the one or more valves such that the one or more valves actuate to an open condition.

Further disclosed is a method for retrieving and reconnecting an upper completion which includes closing one or more barrier valves in a lower completion proximate a downhole-most end of the upper completion, retrieving the upper completion, reconnecting one of the original upper completion or a new upper completion to the lower completion by stabbing a replacement portion into a first portion of a connection sub connected to the lower completion, and applying tubing pressure through the replacement portion to the first portion of the connection sub and to the one or more barrier valves thereby opening the one or more barrier valves.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
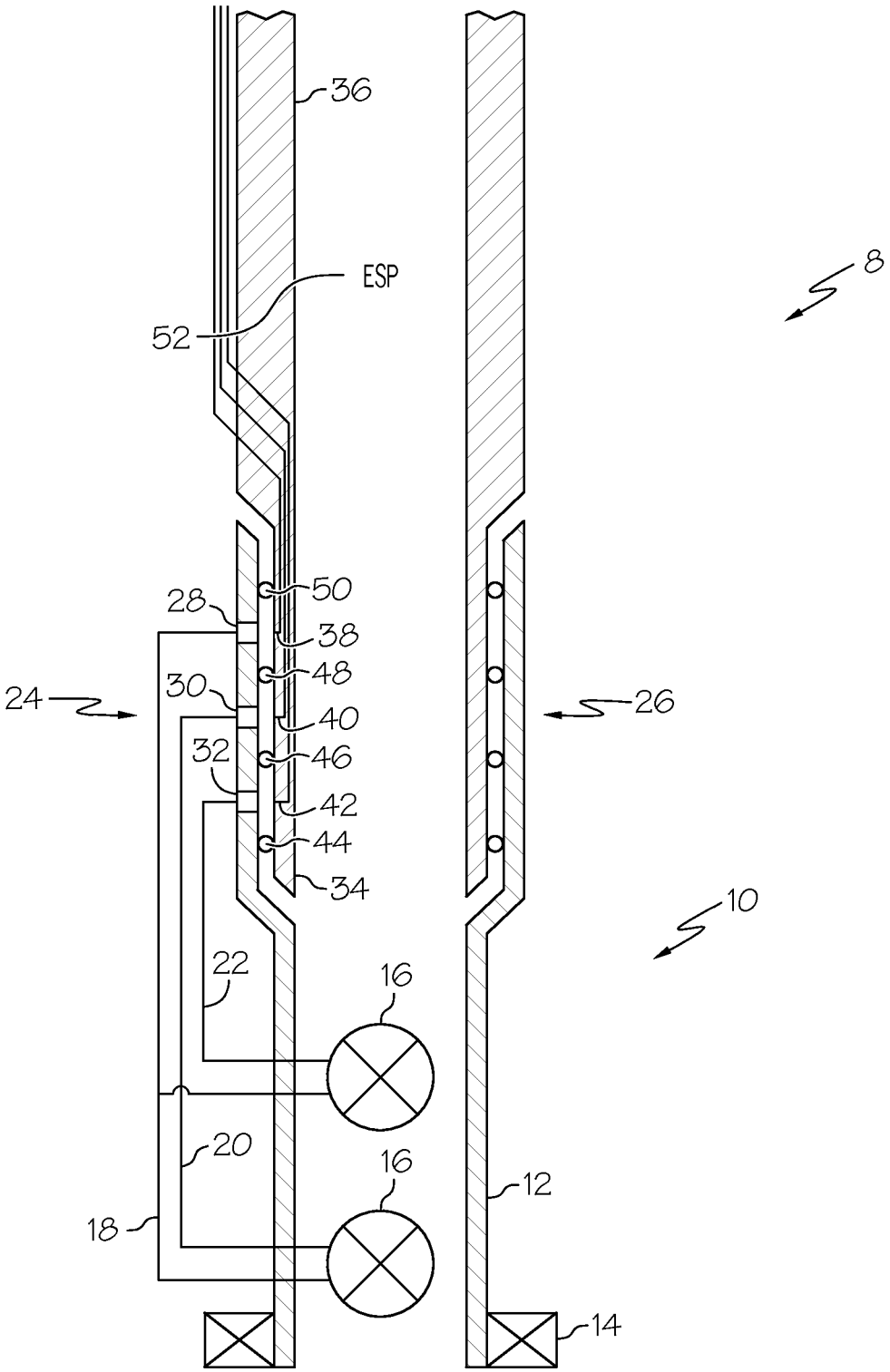
FIG. 1 is a schematic view of a barrier system.

Referring to FIG. 1, an exemplary borehole completion 8 including a barrier valve system 10 is illustrated. The completion 8 includes a lower completion 12 having a packer 14, and part of the barrier valve system 10 having one or more barrier valves 16 (illustrated as two but not limited to two) proximate an uphole extent of the lower completion 12. The barrier valve system 10 itself comprises the one or more barrier valves 16, control lines 18, 20, 22 and an annular connection sub 26, all of which are discussed hereunder. The barrier valves 16 are in operable communication with the control lines 18, 20 and 22 (in this exemplary embodiment, more or fewer are contemplated). The control lines 18, 20 and 22 terminate at a first portion 24 of the annular connection sub 26 having ports 28, 30 and 32 extending radially of the portion 24 of the sub 26. The portion 24 of the sub 26 is interactive with a second portion 34 of the connection sub 26 that is connected to an upper completion 36. The second portion 34 also includes radial ports that are annularly in communication with the ports 28, 30 and 32. The ports of portion 34 are labeled 38, 40 and 42 as three are shown but it is again noted that more or fewer are contemplated and that there are not necessarily the same number of ports on each portion of the connection sub 26. Rather, depending upon where seals are located within the connection sub 26, one or more control lines may be connected to one or more other control lines as desired. The connection sub is more fully described in U.S. Pat. No. 7,487,830, the entire disclosure of which is incorporated herein by reference.

It will be appreciated in FIG. 1 that the connection sub 26 includes a number of seals (illustrated as four in FIG. 1) 44, 46, 48, 50 that separate various port connections from each other. This provides in the illustrated embodiment three control lines extending from the upper completion (likely to surface) to the lower completion. It is to be appreciated that the seals are mounted to the portion 34 so that they are removed from the connection sub 26 upon retrieval of the upper completion 36. This is important to functionality of the system herein described as will be more apparent in the discussion below. As illustrated the three lines are for a common close line that will close all barrier valves of the lower completion upon pressure applied therein and two open lines that will selectively open each of the illustrated barrier valves. The installed system 10 will work appropriately in this configuration.

Upon retrieval of an ESP 52 along with the upper completion 36, the barrier valves 16 will need to be closed to prevent downhole fluids escaping the completion through an open upper extent of the lower completion 12. This will be accomplished by pressuring the common control line 18 for closure of the valves 16. The upper completion 36 may then be withdrawn from the borehole. Upon reintroducing a new upper completion 36 or the original one, the barrier valves 16 must be reopened to reestablish flow potential through the borehole completion system 10. Wet connection as noted above can be problematic and hence the inventor hereof has devised a way to simplify reconnection using a much easier to connect configuration and applied tubing pressure for actuation of the valves 16.

Figure 2:
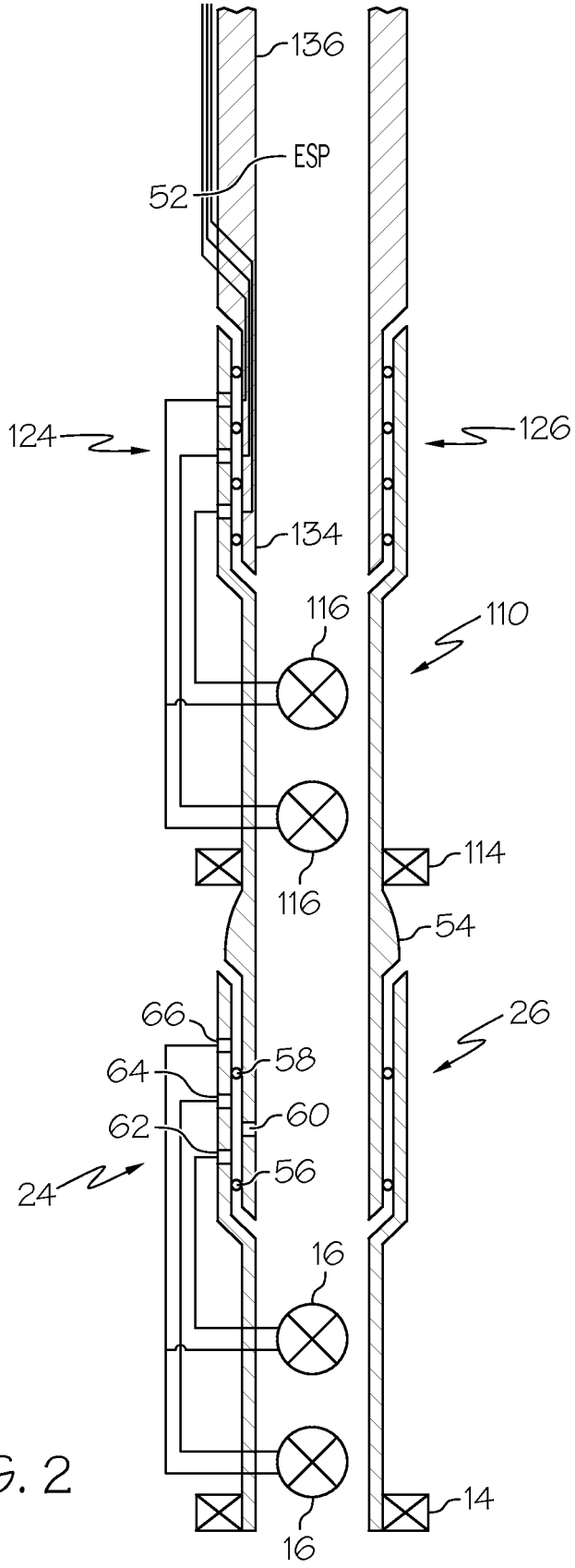
FIG. 2 is a schematic view of a reconnect system operable with the FIG. 1 barrier system.

More specifically, and referring to FIG. 2, a schematic illustration of the reconnect configuration is presented. Reference is made to first portion 24 of connection sub 26 for continuity from the previous discussion. This portion of the connection sub 26 does not change. Moreover, the reader is reminded that the seals were removed with the second portion 34 of the connection sub 26 when the upper completion was retrieved from the borehole leaving the first portion 24 a seal bore. The replacement portion 54 of the connection sub 26 presents seals 56 and 58 in a different position than the seals 44, 46, 48, 50 were in with the original portion 24 of connection sub 26. Rather, seals 56 and 58 are positioned on either side of a port 60 through the replacement portion 54 to an inside diameter thereof such that tubing pressure is ported to a space between seals 56 and 58.

It was noted above that as an exemplary embodiment, the illustrated configuration has two open lines and a common close line. The ports for these lines are in portion 24 and are labeled 62, 64 and 66. The replacement portion 54 does not use the common close line port 66 as can be seen in the drawing, as it is not within the annular space defined by the seals 56 and 58. The ports 62 and 64 are however located between the seals 56 and 58 on replacement portion 54 when the replacement portion is landed in portion 24. This allows the system to provide tubing pressure to the two "open" ports 62 and 64 and through those open the barrier valves 16 that had been closed prior to retrieving the ESP 52 and the upper completion 36. These barrier valves 16 are to remain permanently open at this point. And the original (or previous) portion 24 is not again used to control the now permanently open valves 16.

As can be seen in FIG. 2, the replacement portion 54 is the downhole end of a new barrier valve system 110 having a packer 114, one or more valves 116, a first portion 124 and a portion 134 of a connection sub 126 and control lines equivalent to those described above. This system 110 is affixed to a downhole end of a new or re-run upper completion string 136 and new or repaired ESP 152. The system provides for a very simple and tolerant wet connect that uses only tubing pressure to actuate previously closed valves 16 to the open position where they will remain pursuant to the addition of one or more new barrier valves 116 to replace the function of the previous ones should the need arise to retrieve the ESP 152 again. Potential pitfalls of conventional wet connect arrangements are avoided through the use of the applied tubing pressure based concept disclosed herein.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A barrier valve system comprising:

two or more barrier valves;

a connection sub having a first portion and a second portion connecting one or more control lines to each other; and a replacement portion of the connection sub connectable to the first portion subsequent to retrieval of the second portion, the replacement portion having a port from an outside diameter of the replacement portion to an inside diameter of the replacement portion and a first seal and a second seal disposed to define an annular space between the first seal, the second seal, the replacement portion and the first portion encompassing two or more valve opening ports in the first portion, the two or more valve opening ports in the first portion being operably connected to the two or more barrier valves and configured to open the two or more barrier valves in response to pressure supplied through the two or more valve opening ports.

2. A barrier valve system as claimed in claim 1 wherein the system further includes, attached to the replacement portion, one or more new barriers and a new connection sub.

3. A barrier valve system as claimed in claim 2 wherein the system further includes a new electric submersible pump connected to the one or more new barriers.

4. A barrier valve system as claimed in claim 1 wherein the system further includes an electric submersible pump.

5. A barrier valve system as claimed in claim 1 wherein applied tubing pressure is operative to open the two or more barrier valves.

6. A barrier valve system as claimed in claim 1 wherein the two or more barrier valves is two barrier valves.

7. A method for retrieving and reconnecting an upper completion comprising:

closing two or more barrier valves in a lower completion proximate a downholemost end of the upper completion;

retrieving the upper completion;

reconnecting one of the original upper completion or a new upper completion to the lower completion by stabbing a replacement portion into a first portion of a connection sub connected to the lower completion, forming an annular space between the first portion, the replacement portion, a first seal and a second seal in fluidic communication with two or more valve opening ports in the first portion in operable communication with the two or more barrier valves; and applying tubing pressure through the replacement portion to the first portion of the connection sub and to the two or more barrier valves through the annular space and through the two or more valve opening ports thereby opening the two or more barrier valves.

8. A method as claimed in claim 7 wherein the closing is carried out by applying pressure through one or more closing ports to the two or more barrier valves.

9. A method as claimed in claim 7 wherein the retrieving includes separating a second portion of the connection sub from the first portion of the connection sub.

* * * * *